United States Patent [19]

Nguyen

[11] Patent Number: 5,058,662

[45] Date of Patent: Oct. 22, 1991

[54] MULTI TUBE HEAT EXCHANGER WITH INTEGRAL TUBE SPACERS AND INTERLOCKS

[75] Inventor: Hung P. Nguyen, E. Amherst, N.Y.

[73] Assignee: General Motors Corporation, Detroit, Mich.

[21] Appl. No.: 588,393

[22] Filed: Sep. 26, 1990

[51] Int. Cl.[5] ..... F28D 1/02; F28F 3/14

[52] U.S. Cl. ..... 165/76; 165/78; 165/153; 165/178; 165/176; 228/183

[58] Field of Search ..... 165/152, 153, 76, 78, 165/178; 228/183

[56] References Cited

U.S. PATENT DOCUMENTS

| | | | |
|---|---|---|---|
| 1,302,627 | 5/1919 | Boblett | 165/152 |
| 3,292,690 | 12/1966 | Donaldson | 165/152 |
| 4,350,201 | 9/1982 | Steineman | 165/76 |
| 4,470,455 | 9/1984 | Sacca | 165/153 |
| 4,723,601 | 2/1988 | Ohara et al. | 165/153 |
| 4,800,954 | 1/1989 | Noguchi et al. | 165/153 |

FOREIGN PATENT DOCUMENTS

| | | | |
|---|---|---|---|
| 0248991 | 10/1987 | Japan | 165/153 |
| 63-306394 | 12/1988 | Japan . | |
| 0057095 | 3/1989 | Japan | 165/153 |

*Primary Examiner*—John K. Ford

*Attorney, Agent, or Firm*—Ronald L. Phillips

[57] ABSTRACT

The tubes of a heat exchanger core are interlocked and spaced from are another prior to brazing in a furnace. Each of the separate plates of each tube is formed with discrete laterally spaced tabs which project transversely to the plane of the plate for spacing and for locking adjacent tubes with one another. These tabs are an integral part of stamped plate and are bent so that they are generally perpendicular to the plane of the plate. The locking tabs have a flat, upturned locking end that is resilient to closely fit over the end of an adjacent plate of an adjacent tube to interlock adjacent tubes together.

9 Claims, 3 Drawing Sheets

MULTI TUBE HEAT EXCHANGER WITH INTEGRAL TUBE SPACERS AND INTERLOCKS

BACKGROUND OF THE INVENTION

This invention relates to heat exchangers and more particularly to a heat exchanger core having a plurality of substantially identical tubes with integral interlocks and spacers that maintains tube position and alignment and provide tube support so that the tubes can be compressively clamped and temporarily held together for subsequent permanent connection by brazing in a furnace without damage to the tubes or corrugated air centers therebetween.

FIELD OF INVENTION AND PRIOR ART

In order to produce a flat tube type heat exchanger such as is used in a condenser in an automotive air conditioning system, thin plates are stamped from aluminum or other suitable metal. These plates, with brazing filler metal therebetween, are paired to form tubes which operatively interconnect with one another. The flattened main body portions of adjacent tubes are laterally spaced and receive corrugated air centers therebetween. These air centers are installed in the spaces between adjacent tubes with brazing filler metal to form an initial buildup of the core. The core is mechanically clamped in a stacker and brazed in an oven such as an induction furnace whose temperature is carefully controlled so as to be above the melting point of the brazing filler metal and below that of the metal core plates and the air centers. After brazing, the core is released from the stacker and is finished for subsequent handling and installation in the air conditioning system.

SUMMARY OF THE PRESENT INVENTION

To precisely control the alignment and spacing of the tubes and to prevent crushing of the air centers during the initial clamping and subsequent brazing operations, it is desirable to provide appropriate support of the core tubes at both their upper and lower extremities. The present invention provides new and improved spacers and interlocks for the heat exchanger core tubing which effectively interlocks all of the tubes to one another and precisely spaces and supports the tubes so that a core can be initially built and clamped without damage to the core plates or the air centers prior to and during brazing in the furnace.

In a preferred embodiment of this invention, each of the separate plates of each tube is formed with discrete laterally spaced tabs which project transversely to the plane of the plate for spacing and for locking adjacent tubes with one another. These tabs are an integral part of the stamped plate and are bent so that they are generally perpendicular to the plane of the plate. The locking tabs have a flat, upturned locking end that is resilient to closely fit over the end of an adjacent plate of an adjacent tube to interlock adjacent tubes together. Straight spacer tabs are used to space separate tubes from one another. These spacer tabs are similar to the locking tabs but have straight abutment ends instead of the flattened locking end portions to provide column support. With the locking and spacing tabs in place, the tubes are arrayed in a core which is securely interlocked and accurately spaced.

This featured construction prevents crushing of the air centers and tubes when a clamping force is applied to the initial core assembly. This compressive force increases during brazing due to expansion of the core. However, the interlocking tabs hold the tubes together and the column support and reinforcement provided by the spacer tabs prevents damage to the air centers and other core components from these clamping and expansion forces so that this construction optimizes plate interfitting and tube stacking for the production of a high quality brazed core.

It is a feature, object and advantage of this invention to provide a new and improved heat exchanger core having flatten tubes that each formed from a pair of plates that have with integral spacer and locking tabs so that one end of each tube can be spaced and joined to corresponding end of an adjacent tube for the build of a exchanger core with tubes interlocked and accurately spaced for subsequent clamping and brazing without core damage.

These and other features, objects and advantages of the present invention will be more apparent from the following Detailed Description and Drawing in which:

Figure 1:
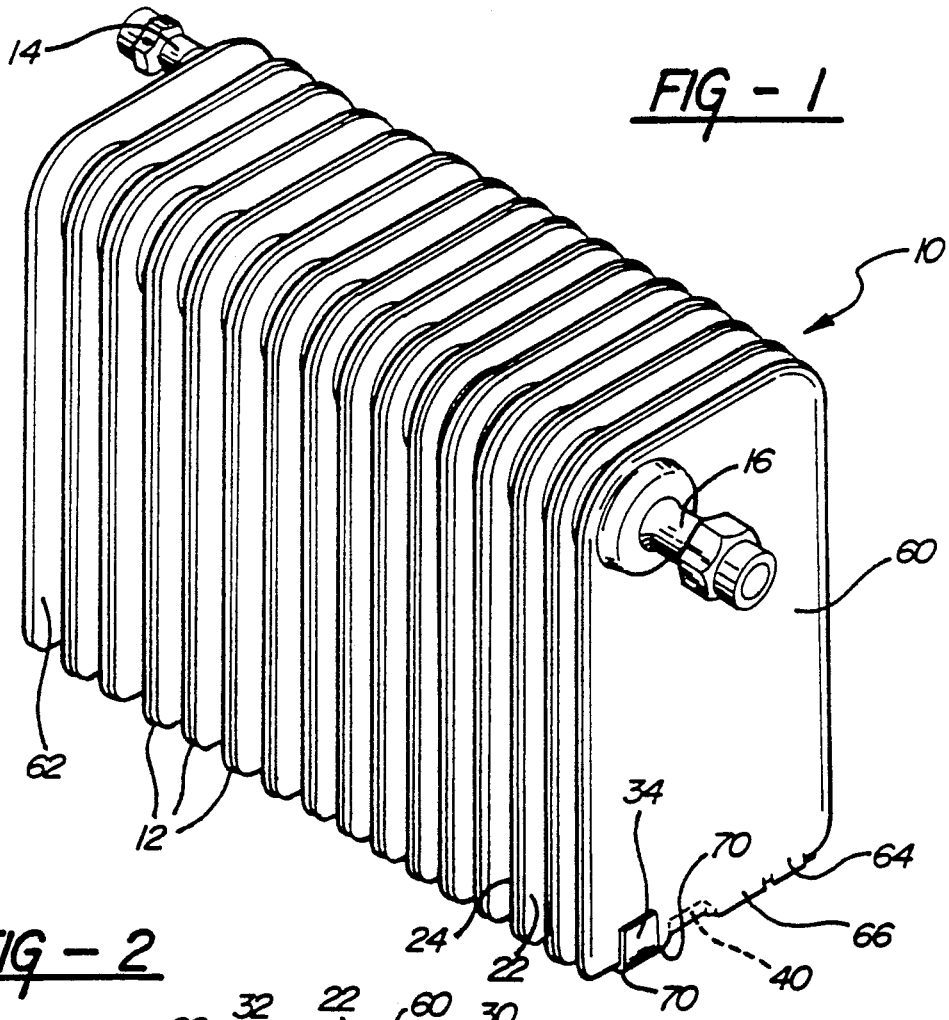
FIG. 1 is a pictorial air view of an evaporator core for an automotive air conditioning system.

Turning now in greater detail to the drawings, there is shown in FIG. 1 a finned cross flow heat exchanger 10 in the form of an evaporator core for automotive air conditioning system adapted to be mounted within a module in the engine compartment of the automobile. The heat exchanger 10 comprises a plurality of generally flattened fluid conducting tubes 12 hydraulically connected in series with one another to provide a serpentined flow path for the heat exchanger fluid supplied thereto by way of an intake 14 operatively connected into the first tube 12. After changing phases while flowing through the core, the fluid is discharged from the last tube of the heat exchanger through a pipe 16 which can be operatively connected to the compressor of the system not shown. The separate tubes 12 are parallel and are joined to each other at their upper and lower ends arranged to define spaces 18 and accommodate the corrugated air centers or fins 20. These air centers, fixed between the flattened body portions of each of the plate are corrugated thin sheets of aluminum or other suitable metal and operate to increase the heat transfer performance of a heat exchanger. In an air conditioner evaporator, a cross flow of air forced through the fins loses heat energy to the refrigerant circulating through the tubes which boils and vaporizes and is then discharged by the pipe 16 to the compressor thereby cooling the interior of the vehicle.

Figure 5:
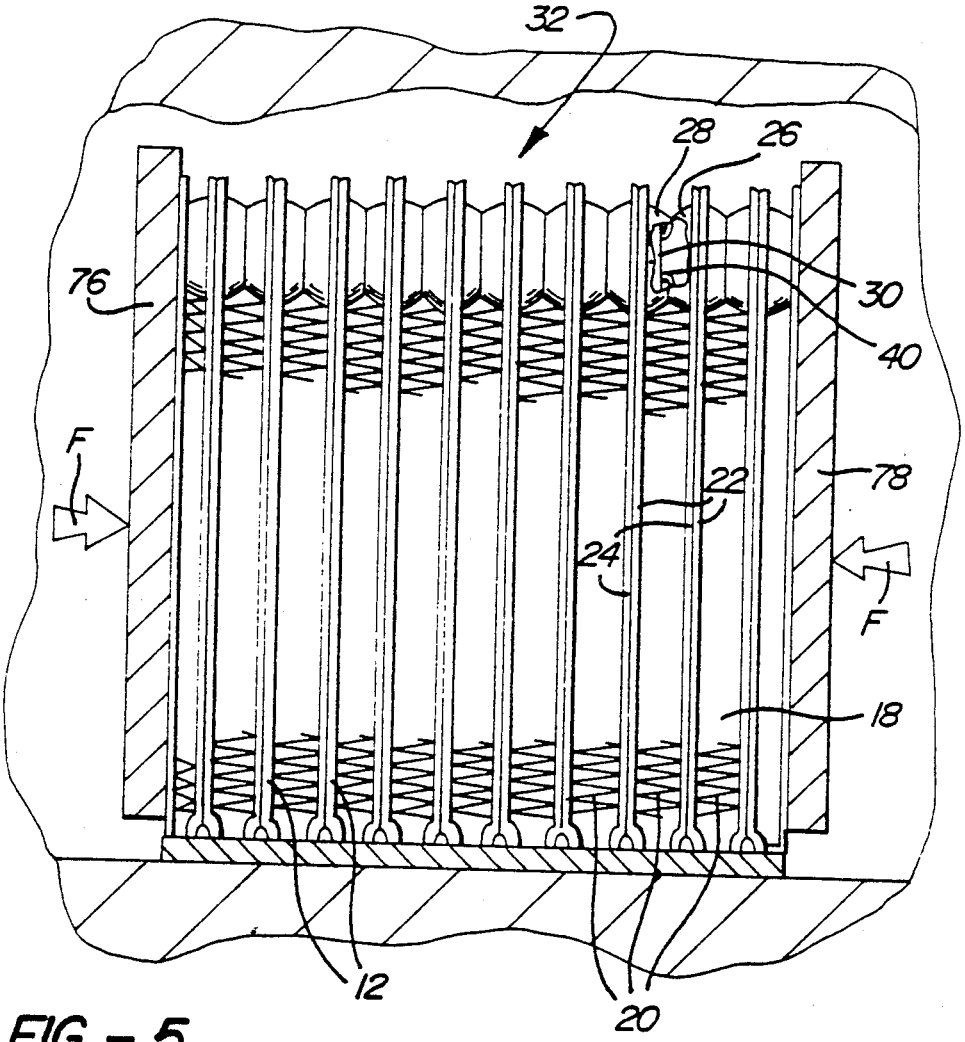
FIG. 5 is a diagrammatic view of the evaporator core of FIG. 1 clamped and in a brazing oven.

Each tube 12 is fabricated from a pair of mating plates 22 and 24 which are substantially identical to one another. Each plate is a stamping which is basically, flat except that the upper end has a pair of side by side oval protuberances 26 and 28 with openings such as opening 30, see FIG. 5, so that adjacent tubes operatively interconnect with one another to transmit heat exchanger fluid. The interconnected protuberances define a tank portion 32 of the core. The protuberance 26 has an axially extending annular collar 40 around openings 30 which closely fits and connects into the opening of the protuberance 28 of adjacent tube.

In addition to the extending bulb like protuberances, each of the plates is formed with an elongated inwardly projecting divider rib which extends about $\frac{3}{4}$ of the length of the each plate for brazed connection to a corresponding rib of a mating plate to form a partition in the tube so that the refrigerant is forced in a circuitous path through each tube from the inlet to the outlet.

In addition to the divider ribs, each core plate has a pattern of inwardly extending dimples or bumps which, when the core plates are brazed together, provide for optimized mechanical strength and varying flow paths through each tube for effective transfer of heat energy between the heat exchanger fluid and the ambient air.

Figure 2:
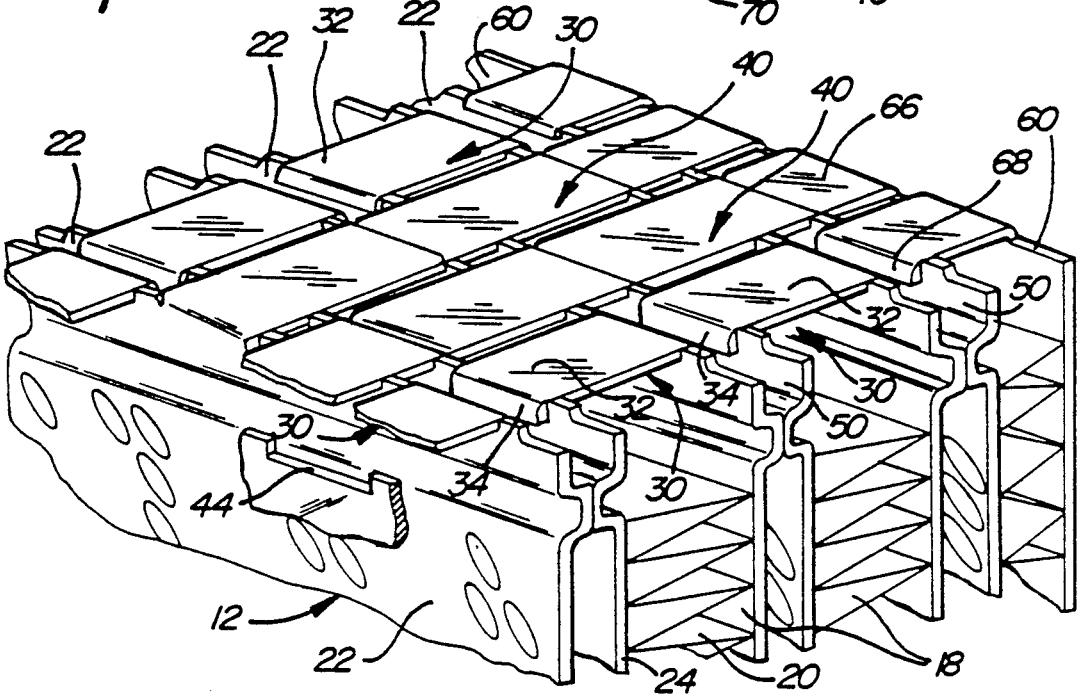
FIG. 2 is a pictorial view of the bottom of the evaporator core of FIG. 1.
Figure 3:
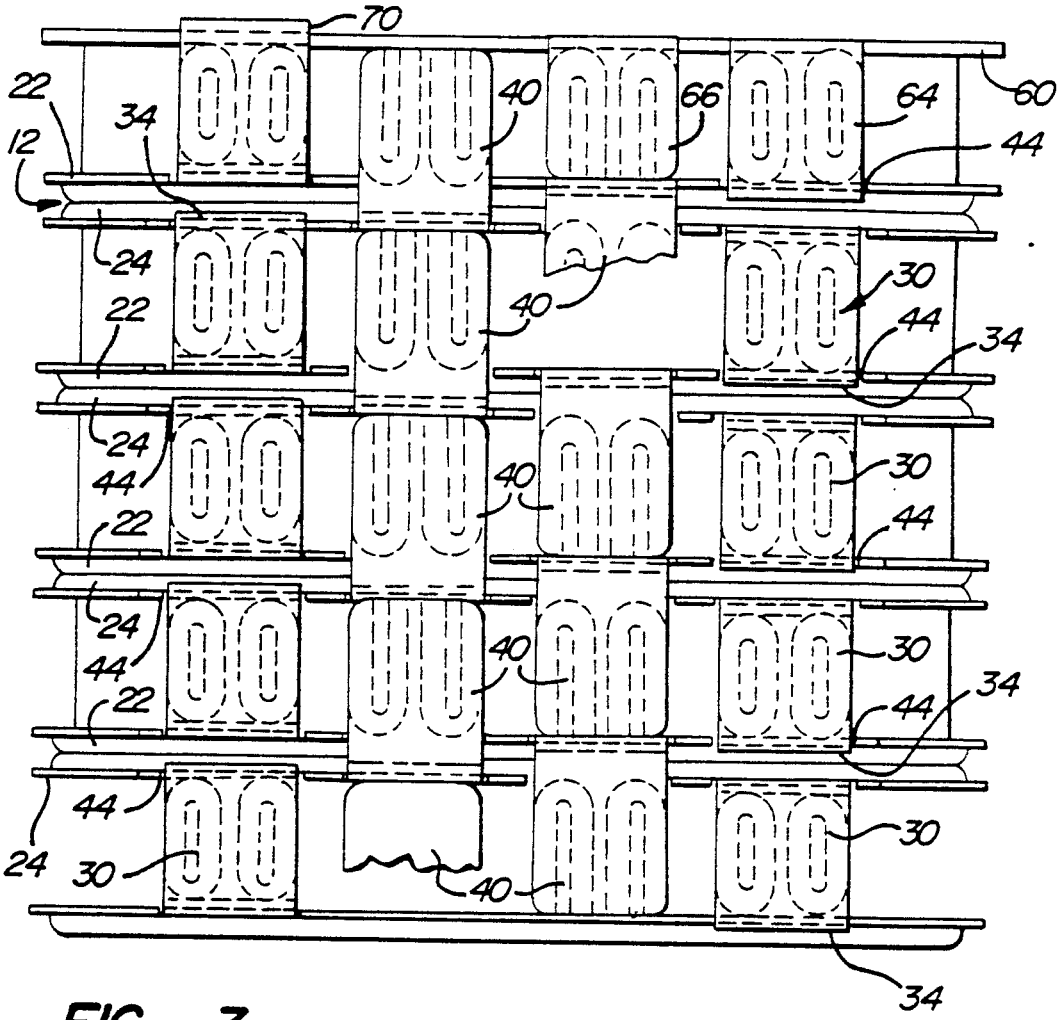
FIG. 3 is a bottom plan view of a portion of the evaporator core of this invention.
Figure 6:
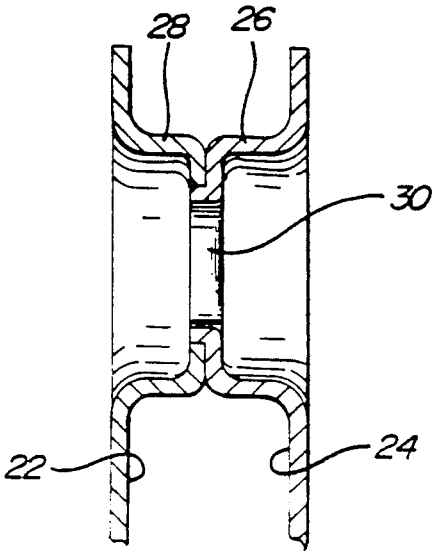
FIG. 6 is an enlarged section view of a portion of FIG. 5 illustrating attachment of two adjacent plates at their tank end.
Figure 4:
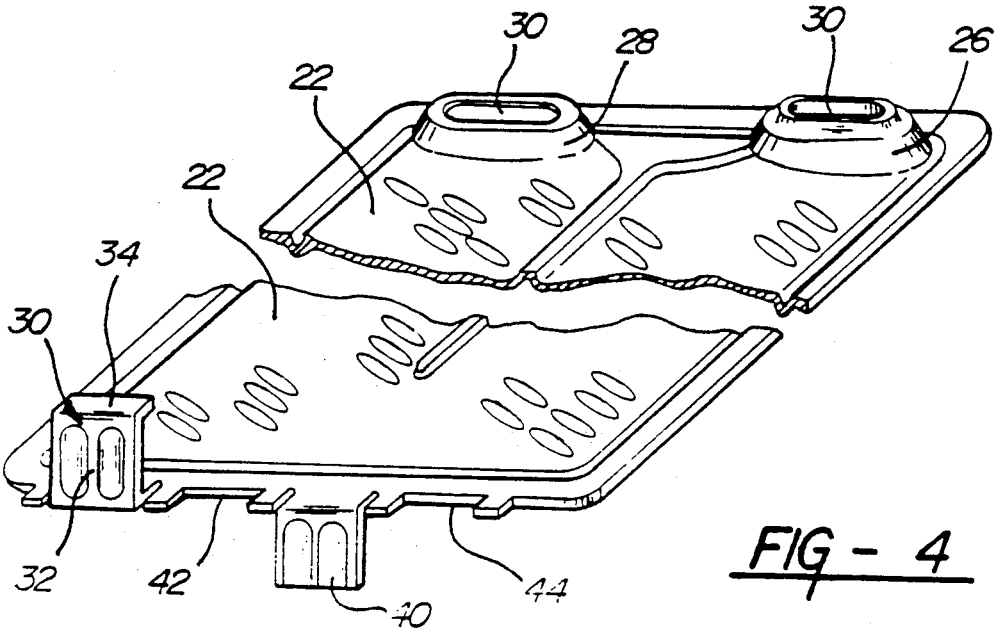
FIG. 4 is a pictorial view of a plate of the one of the tubes.

Importantly in this invention, the lower end of each plate, 22 or 24, has a locking tab 30 having a base 32 bent at right angles with respect to the plane of the plate and an upwardly extending spring-like retainer or locking end 34 which when the tubes are stacked locks two adjacent tubes together so that the core of tubes cannot be readily pulled apart by longitudinal or lateral separating forces. In addition to the locking tabs, the tubes are spaced a predetermined distance from one another by spacing tabs 40 which are formed integrally with each plate. As shown in FIGS. 2, 3 and 4, each spacing tab is bent at right angles to the plane of the body of the associated plane and extends in an opposite direction with respect to the locking tab of that plate. Each plate further has an inboard spacing notch 42 and an outboard locking notch 44 in the lower end thereof on opposite sides of the spacing tab. The base 32 of the locking tab 30 extends through locking notch 44 and the upwardly turned retainer end 34 fits with locking engagement with the back surface of the next adjacent plate of the adjacent tube. The spacing notch 42 allows a spacing tab 40 from one plate of one tube to extend across the lower end of the associated tube into physical contact with the side of an adjacent plate of an adjacent tube. The notches interfit with the locking and spacer tabs to interlock the tubes against relative lateral movement.

The arrangement is best shown in FIGS. 2 and 3 each tube 12 is formed by plates 22 and 24 joined in face to face relationship. Each of the plates 22 and 24 has an extended lower flange 50 formed with a locking tab 30, a spacing tab 40 and the notches 42, 44. The locking tabs 30 extends from one tube across the air center spaces 18 and through an notch 44 which is an outboard notch in a plate of the associated adjacent tube. The locking end 34 of the locking tab 30 projects onto the inner face of the flange 50 of the plate to yieldably grip and lock two tubes together. Each spacing tab 40 extends from the flange of the plate through the inboard notch 42 in the flange of the plate and then across air center space 18 and into abutment with the flange of the plate of the next adjacent tube or the root of the next aligned spacing tab 40. Accordingly with this arrangement, the tubes are spaced from one another as determined by the length of the spacing tabs. The spacer tabs in effect hold these two tubes apart while the locking tabs interlock and provide a force urging two tubes together. Since all of the tubes are locked and spaced in a similar manner by the discrete locking and spacing tabs, an array of tubes can be assembled into a core.

In this invention, flattened end plates 60, 62 are provided with integral and inwardly extending locking and spacing tabs 64, and 66 respectively. The locking tab 64 extends inwardly and at right angles to the plane of the end plate through a notch 44 of the adjacent plate of a tube, and the locking or retainer end 68 thereof locks onto the inner surface of the flange 50 of the outboard plate of the adjacent tube, as shown. The spacer tab is next to the locking tab and is bent at right angles to contact the outer surface of the flange 50 of the outboard plate of the last tube.

Each end plate has a tab receiving notch 70 which receives the extending locking tab 30 of the end most plate. The retainer end 34 of this tab extends upwardly into locking engagement with the outer surface of the end plate. The spacer tab 40 of the outermost tube contacts the inner surface of the end plate for support thereof. The end plate 62 is like the end plate 60 and is tabbed to the tubes 12 adjacent thereto by the same tabbing arrangement.

Accordingly, with this invention the core can be initially built up by interfacing pairs of plates 22, 24 with brazing metal therebetween to provide a plurality of tubes. These tubes are connected at their upper ends by the tank portions and at their lower ends joined by the spacing and locking tabs. The plates and the tubes are interlocked and spaced by the locking and spacing tabs and the air centers are installed between the tubes with appropriate filler metal during core build up. The end plates are installed as desired. A stacker with opposing clamping jaws shown diagrammatically as jaws 76, 78 provides the clamping forces to the core. After clamping, the oven is heated to a point at which the plates are permanently jointed to one another to form tubes 12, and the tubes are brazed to one another and the centers are brazed to the tubes. The spacing and locking tabs effectively resist the clamping force applied by the stacker and the expansion forces from core expansion during the brazing process. Accordingly, when brazing is completed the core tubes and air centers are not crushed or distorted and a precisely aligned and optimally effective heat exchanger core is produced.

The resulting bottom of the core presents a flattened surface as formed by the spacers and locking tabs as best shown in FIG. 2 which provides for better handling and installation without sharp edges for improving the installation. The spacer tabs provide for exceptional column strength to resist crushing and these tabs can be brazed together if desired.

While a preferred embodiment of the invention has been shown and described, other embodiments will now become apparent to those skilled in the art. Accordingly, this invention is not to be limited to that which is shown and described but by the following claims.

I claim:

1. A heat exchanger core having a series of flattened fluid plates joined together in pairs to provide a plurality of flow tubes operatively interconnected with one another to transmit pressurized fluid therethrough from an intake to a discharge respectively operatively connected to the first and last of said tubes, each of said tubes having a tank portion at one end thereof, each said tank portion having an inlet and an outlet, said outlet of each said tubes being operatively connected to the inlet of the next adjacent tube, each of said tubes having a main body portion defining a fluid flow path from said inlet to the outlet thereof, the improvement comprising a locking and spacing end forming the other end of each of said tubes, discrete spacing tab means integral with said locking and spacing end of each said tubes and extending laterally therewith in a column to directly contact an aligned surface of an adjacent tube on said locking and spacing end of each said tubes to space said tubes at a predetermined distance from one another and discrete locking tab means on said locking and spacing end of each of said tubes and extending laterally therefrom in a direction opposite to that of said spacing tab means to the next adjacent tube and terminating at a predetermined upwardly extending retainer end for directly contacting and connecting adjacent tubes to one another so that said tubes are tightly interlocked together and are spaced at a predetermined distance from one another to prevent core damage by compressive forces applied to said tubes and to prevent said core from being pulled apart.

2. A heat exchanger core formed by a series of flattened fluid flow tubes operatively interconnected with one another to transmit pressurized heat exchanger fluid therethrough, said tubes having main body portions that extend downward from upper tank portions to terminal ends, air center means operatively disposed between adjacent tubes, said terminal ends of each of said tubes having discrete integral spacing tabs that extend laterally in a first direction from one tube over into positive contact with the next tube to effect the spacing of said tubes from one another and to provide a plurality of aligned spacing tabs to provide a continuous column and to optimize column strength to said core to prevent damage to said air center means by crushing forces exerted on the core, said terminal ends of each of said tubes further having discrete locking tabs which have main body portions that extend laterally in a direction opposite to said first direction and from one tube to an adjacent tube, each of said locking tabs having spring like end retainers which extend at an angle with respect to said main body portion and into positive locking engagement with the next adjacent tube thereby interlocking the lower ends of the tubes of the core, said locking and spacing tabs providing a substantially flat lower surface facilitating core handling.

3. A heat exchanger core having a series of fluid flow tubes operatively interconnected with one another to provide a flow path for transmitting pressurized heat exchanging fluid therethrough from an intake operatively connected to a first of said tubes to a discharge operatively connected to a last of said tubes, each of said tubes having a flattened main body having an enlarged fluid transferring tank portion forming one end thereof and a locking and spacing portion at the other end thereof, each said tank portion having an inlet and an outlet for said fluid, said outlet of said tanks of one of said tubes being operatively connected to the inlet of the next adjacent tube, air center means operatively mounted between adjacent tubes, the improvement comprising first tab means forming spacer tab means extending in a first direction from root ends of said locking and spacing portion end of each of said tubes and extending to the root end of the next adjacent spacer tab means on the next adjacent tube so that they are aligned with one another and effect the spacing of said tubes from one another and second tab means forming locking tab means integral with said locking and spacing end of each of said tubes and extending in a direction opposite to said first direction to positively engage and lock adjacent tubes to one another at their locking and spacing portions so that all of said tubes are interlocked together and are spaced at a predetermined distance form one another to prevent said air centers from being crushed by external forces applied to said tubes.

4. The heat exchanger core of claim 3 wherein all of said first tab means are angularly disposed with respect to said tubes and aligned with one another to extend in a substantially straight and continuous course from said first tube to said last tube in said core.

5. The heat exchanger core of claim 3 wherein said tubes have first and second notches through which said first and second tab means respectively extend.

6. A heat exchanger core having a series of fluid flow tubes operatively interconnected with one another to provide a serpentined flow path for transmitting pressurized heat exchanging fluid therethrough from an intake operatively connected to a first of said tubes to a discharge operatively connected to a last of said tubes, each of said tubes having a flattened main body and having an enlarged fluid transferring tank portion forming one end thereof and locking and spacing portion forming the other end thereof, each said tank portion having an inlet and an outlet for the fluid, said outlet of said tanks of said tubes being operatively connected to the inlet of the next adjacent tube downstream thereof, air center means operatively mounted between adjacent tubes, the improvement comprising first tab means on said locking and spacing portion and disposed at a predetermined angle with respect to said main body to extend to and positively contact a portion of the next adjacent tube to form a flat column to space said tubes from one another and second tab means on said locking and spacing end of each of said tubes forming positive lock means to positively interlock adjacent tubes to one another so that all of said tubes are firmly interlocked together at their locking and spacing portions and are spaced at a predetermined distance from one another and slot means in said locking and spacing portions for close interfit with said first and second tab means to prevent the lateral movement of said tubes with respect to one another.

7. The heat exchanger core of claim 6 wherein all of said first tab means are aligned with one another to extend in a substantially straight and continuous course extending from said first tube to said last tube in said core and wherein said second tab means are aligned with one another and having an upwardly extending retainer ends to positively lock onto an associated tube, said first and second tab means providing a planar lower surface of said exchanger.

8. The heat exchanger core of claim 6 wherein said core has flattened end plates forming opposite ends thereof, said plates having tab and notch means arranged so that said plates can be spaced from and locked to the core tubes adjacent thereto by said first and second tab means, associated therewith.

9. A heat exchanger having a plurality of tubes operatively interconnected and laterally spaced from one another for transmitting heat exchanger fluid therethrough, each of said tubes being formed from inter fitted first and second plate means, each of said plate means being a thin walled body having side walls and having a pair of protrusions formed therein with an opening in at least some of said protrusions to provide a heat exchanger fluid receiving tank portion of said heat exchanger when said plate means are interlocked with one another to form tubes and said tubes are operatively interlocked to one another, each of said plate means having a body portion with a divider rib extending between the side walls thereof and having a lower end portion, each said lower end portion having an integral locking tab with an arm portion extending laterally with respect to said associated plate means and terminating in an upwardly extending locking portion for locking engagement with the lower end portion of plate means of a laterally adjacent tube, each said end portion further having a laterally extending spacing tab extending in a direction opposite to said arm portion of said locking tab and having a spacing notch dimensioned to permit said spacing tab to extend therethrough and into contact with the lower end portion of a laterally adjacent tube, and each of said end portions having a locking notch formed therein for receiving the locking arm portion of a plate of an adjacent tube whereby said tubes are spaced and interlocked with one another to thereby tightly secure them together as a core and to prevent the core from separation by parting forces and from being crushed by compressive loads.

* * * * *